US007930836B2

(12) United States Patent
Ueda et al.

(10) Patent No.: US 7,930,836 B2
(45) Date of Patent: Apr. 26, 2011

(54) DRYING SYSTEM FOR A HAIR REMOVING DEVICE

(75) Inventors: Yasunori Ueda, Hikone (JP); Kazuya Shigeta, Inukami-gun (JP); Yasuo Ibuki, Hikone (JP)

(73) Assignee: Panasonic Electric Works Co., Ltd., Osaka (JP)

( * ) Notice: Subject to any disclaimer, the term of this patent is extended or adjusted under 35 U.S.C. 154(b) by 368 days.

(21) Appl. No.: 12/115,153

(22) Filed: May 5, 2008

(65) Prior Publication Data

US 2008/0282571 A1 Nov. 20, 2008

(30) Foreign Application Priority Data

May 14, 2007 (JP) ..... 2007-128508

(51) Int. Cl.
*F26B 19/00* (2006.01)
*F26B 25/06* (2006.01)
*B26B 19/38* (2006.01)

(52) U.S. Cl. ..... 34/90; 34/202; 34/218; 34/237

(58) Field of Classification Search ..... 34/90, 201, 34/202, 218, 237; 30/34, 5
See application file for complete search history.

(56) References Cited

U.S. PATENT DOCUMENTS

| | | | |
|---|---|---|---|
| 5,614,030 | A | 3/1997 | Braun |
| 5,649,556 | A | 7/1997 | Braun |
| 6,305,391 | B1 | 10/2001 | Hoser |
| 6,874,514 | B1 | 4/2005 | Hoser et al. |
| 2002/0069902 | A1 | 6/2002 | Hoser et al. |
| 2002/0078984 | A1 | 6/2002 | Hoser et al. |
| 2005/0126610 | A1 | 6/2005 | Hoser |
| 2008/0282571 | A1 | 11/2008 | Ueda et al. |

FOREIGN PATENT DOCUMENTS

| | | | |
|---|---|---|---|
| CN | 1347287 | A | 5/2002 |
| CN | 201216277 | Y | 4/2009 |
| DE | 44 02 237 | C1 | 3/1995 |
| JP | 4-221593 | A | 8/1992 |
| JP | 8-117016 | A | 5/1996 |
| JP | 2001-512338 | A | 8/2001 |
| JP | 2003-506121 | A | 2/2003 |
| JP | 2003-506122 | A | 2/2003 |
| JP | 2005-199083 | A | 7/2005 |
| JP | 2005-526562 | A | 9/2005 |
| WO | WO 2004/066780 | A1 | 8/2004 |

OTHER PUBLICATIONS

European Search Report for the Application No. EP 08 00 8522 dated Aug. 18, 2008.
Notification of Reasons for Refusal for the Application No. 2007-128508 from Japan Patent Office mailed Jan. 20, 2009.
The First Office Action for the Application No. 200810098130.8 from State Intellectual Property Office of People's Republic of China dated Sep. 25, 2009.

*Primary Examiner* — Jiping Lu
(74) *Attorney, Agent, or Firm* — Cheng Law Group, PLLC

(57) ABSTRACT

A drying system for a hair removing device is capable of effectively drying the cutter head. The drying system includes a casing having a dry chamber configured to detachably receive a cutter head of the hair removing device, a heater for heating the cutter head; and a blower for generating a forced air flow and drying the cutter head. The casing is formed with an air flow channel configured to direct the forced air flow towards the cutter head. A tray is provided to define the bottom of the dry chamber and bear the cutter head. The tray is formed with a draft port through which the flow channel communicates into the dry chamber so that the forced air flow can be directed straight to the cutter head for effectively cooling or drying the cutter head.

5 Claims, 14 Drawing Sheets

DRYING SYSTEM FOR A HAIR REMOVING DEVICE

TECHNICAL FIELD

The present invention is directed to a drying system for a hair removing device, especially an electric shaver.

BACKGROUND ART

Washable hair removing devices have been already available in the art with a benefit of being easily cleaned. In this connection, there is a demand of heating a cutter head after washing the same for sterilization. To meet this demand, Japanese patent publication No. 2005-199083 proposes a heating stand with a function of heating the cutter head while the hair removing device is held on the stand. However, the heating alone is found not sufficient to dry the cutter head and is preferred to be applied in combination with an air blow. Thus, it is desired to provide a drying system with a heater and blower combination. Such drying system could be realized to have a top-opened drying chamber within which the cutter head is exposed to the heat and the air blow, selectively or in combination, as suggested in part from by the prior art publication WO 2004/066780. In the system of the publication, the shaver is placed upside down with its cutter head received in the chamber, i.e., the top of the cutter head being held against a bottom of the chamber, while a blower is disposed upwardly of the chamber in a laterally offset relation therefrom to direct a forced air flow to a side of the cutter head. With this structure, there remains a problem that the air flow is difficult to directly enter into the interior of the cutter head, resulting in poor drying efficiency or requiring much drying time. This becomes particularly critical when the cutter head is heated to an elevated temperature with the use of the heater for sterilization, in which case, the cutter head has to be cooled quickly after being heated to be ready for use.

DISCLOSURE OF THE INVENTION

In view of the above problem, the present invention has been achieved to provide a drying system for a hair removing device which is capable of effectively drying a cutter head in combination with the heat, and is especially capable of quickly cooling the cutter head after heating it to an elevated temperature for sterilization. The drying system in accordance with the present invention includes a casing having a dry chamber configured to detachably receive a cutter head of the hair removing device, a heater disposed in the casing to heat the cutter head; and a blower disposed in the casing to generate a forced air flow for drying the cutter head. The casing is formed with an air flow channel configured to direct the forced air flow towards the cutter head. The dry chamber has its bottom defined by a tray which bears the cutter head. The tray is formed with a draft port through which the flow channel communicates into the dry chamber so that the forced air flow can be directed straight to the cutter head for effectively cooling or drying the cutter head.

Preferably, the draft port is elongated to cove a plurality of hair entrapping holes in the cutter head in order to supply a good amount of the air into the cutter head for efficient cooling and drying.

The tray is preferred to be made of an elastic material to protect the cutter head from being damaged when it is placed into the dry chamber. In addition, the tray may be configured to mount the heater on a rear face of the tray to position the heater as close as possible to the cutter head for efficiently heating the same.

In this connection, the heater is preferably mounted to surround a duct which extends from the draft port of the tray into the air flow channel. Thus, the duct can be heated by the adjacent heater to effectively heat the air flow being directed into the dry chamber.

Further, the tray may be formed in its top surface with at least one groove leading to a drop hole of the tray so as to keep the train free from water trickled from the cutter head just being washed with water, thereby assuring to dry the cutter head rapidly.

The casing may be formed with an inclined bottom wall which is disposed below the drop hole to receive the water out through the drop hole from the tray, and which extends downwardly to a drain port of the casing for discharging the water out of the casing.

These and still other advantageous features of the present invention will become apparent from the following detailed description of the embodiment when taken in conjunction with the attached drawings.

BEST MODE FOR CARRYING OUT THE INVENTION

Referring now to FIGS. 1 to 5, there is shown a drying system for a hair removing device in accordance with a preferred embodiment of the present invention. In the present embodiment, a dry shaver 100 is shown as one typical example of the hair removing device to have a washable cutter head 110 and a rechargeable battery 130 for driving an inner cutter. However, the drying system can be equally applicable to other types of the hair removing device including an epilator or the like having perforated cutter head.

Figure 1:
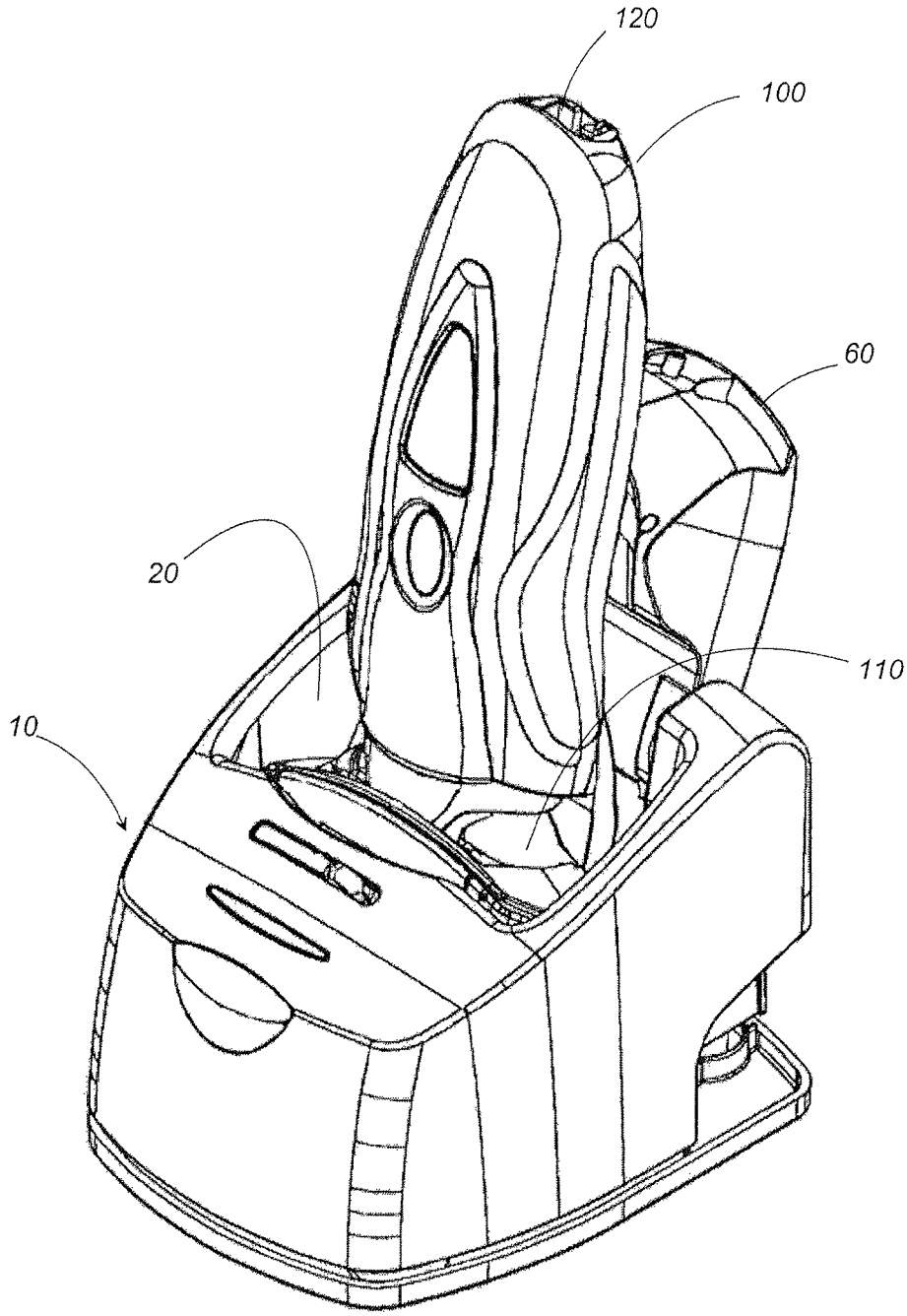
FIG. 1 is a perspective view of a drying system for a hair removing device in accordance with a preferred embodiment of the present invention.
Figure 2A:
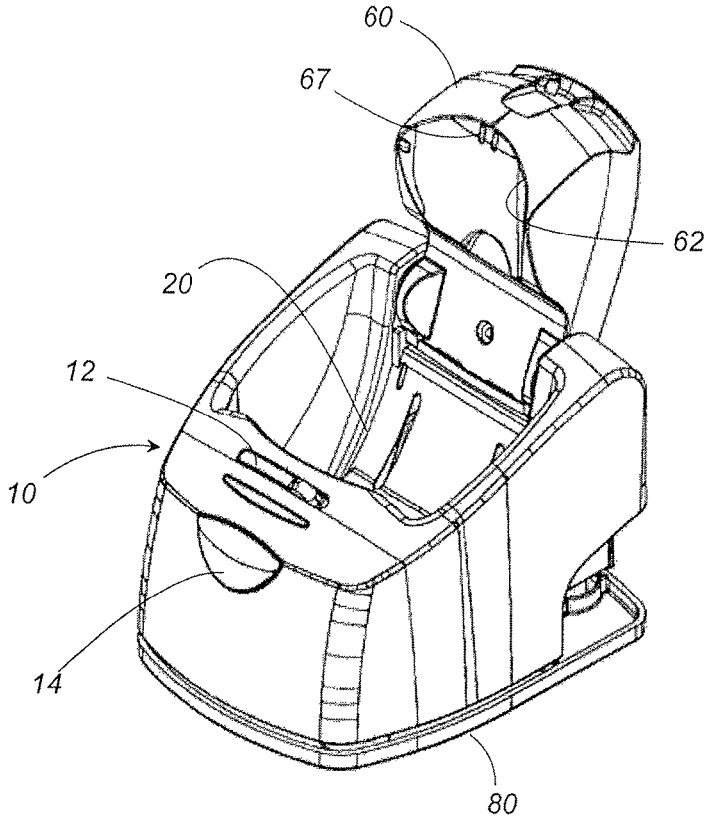
FIGS. 2A and 2B are perspective views of the drying system shown with its lid closed and opened, respectively.
Figure 2B:
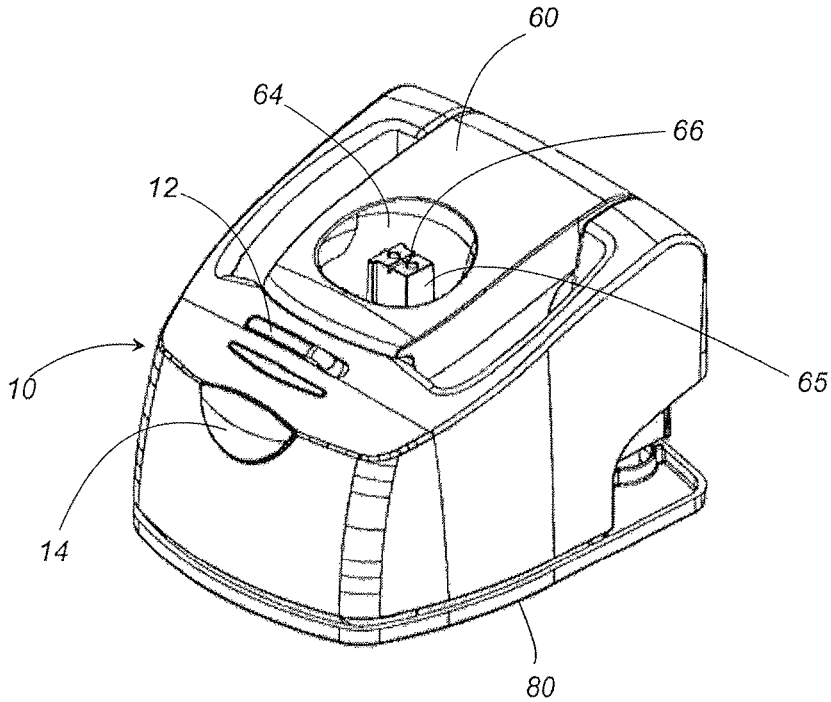
Figure 3:
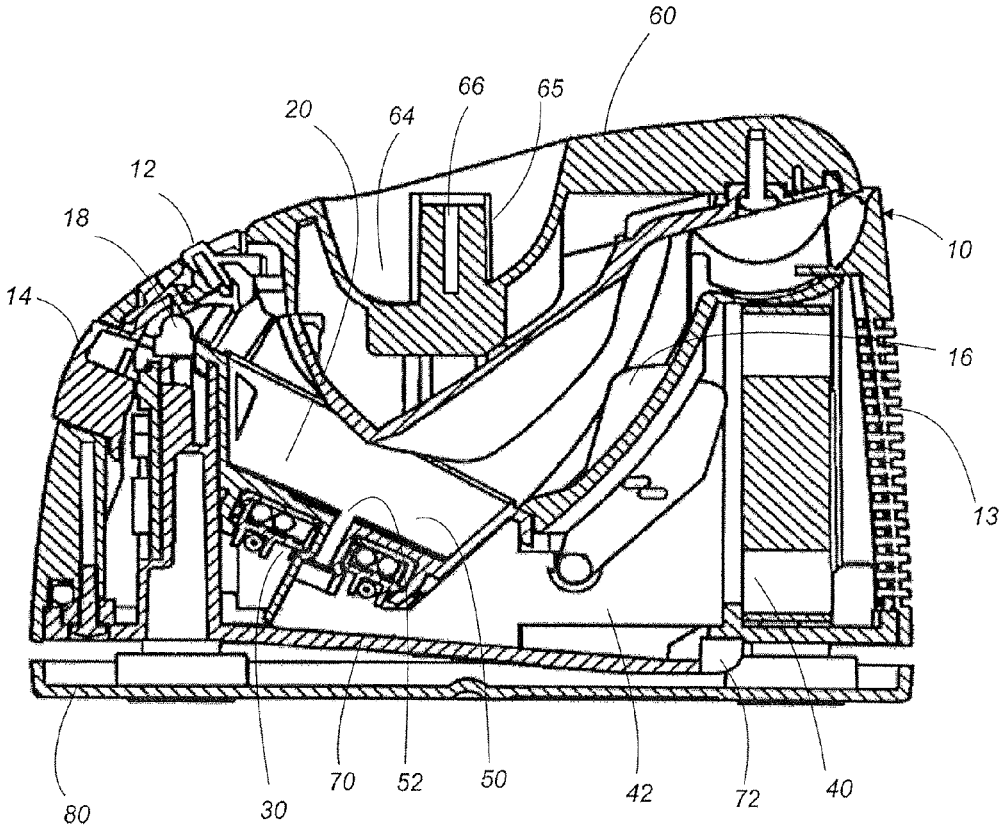
FIG. 3 is a sectional view of the above system.
Figure 4A:
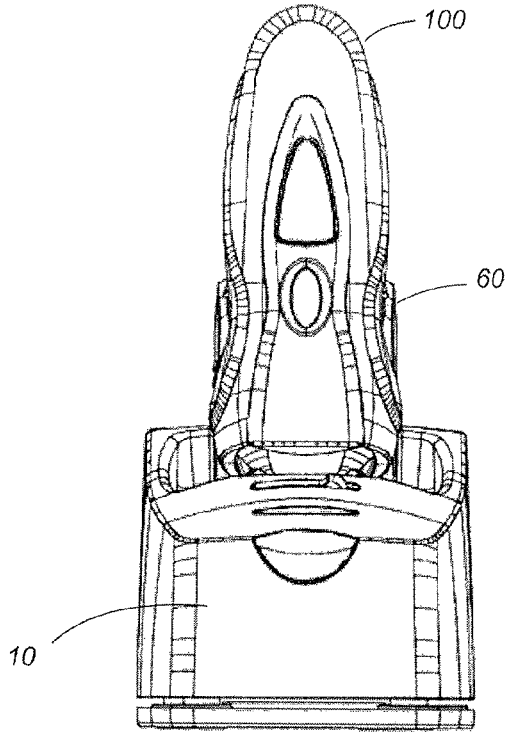
FIGS. 4A to 4C are front, top, and rear views, respectively of the above system shown with a cutter head being received in a dry chamber.
Figure 4B:
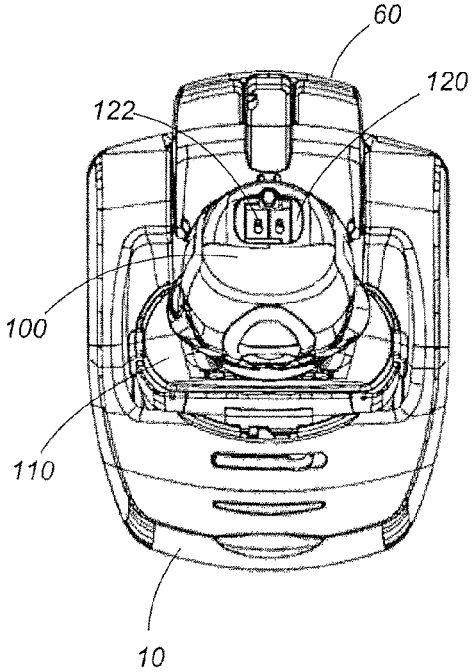
Figure 4C:
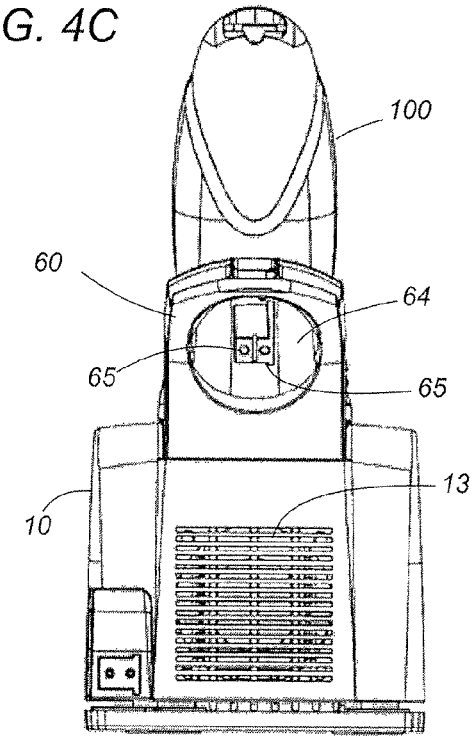

The drying system has a casing 10 shaped to have a dry chamber 20 for detachably receiving the cutter head 110 of the shaver. The casing 10 incorporates a heater 30 for heating the cutter head and a blower 40 for generating a forced air flow to dry or cool the cutter head 110. As shown in FIGS. 2A and 2B, a lid 60 is pivoted to the upper end of the casing 10 to be movable between an open position of opening the dry chamber 20 and a closed position of closing a top end of the dry chamber 20. The lid 60 is spring-biased toward the open position and is locked in the closed position by means of a lock mechanism. A release button 12 is formed on front of the casing 10 to unlock the lid. Provided on the front end of the casing 10 is a switch button 14 which actuates a controlling circuit 90 for energizing the heater 30 and the blower 40 in a manner as will be discussed later. A touch switch 16 is provided in the dry chamber for contact with the cutter head 110 so as to enable the switch button 14 only when the cutter head 110 is in the dry chamber 20. An indicator LED 18 is provided in the casing for indicating the operation of the system. Although not shown in the drawings, additional LED may be provided to emit an ultraviolet radiation to the cutter head for ultraviolet sterilization of the cutter head.

Figure 12:
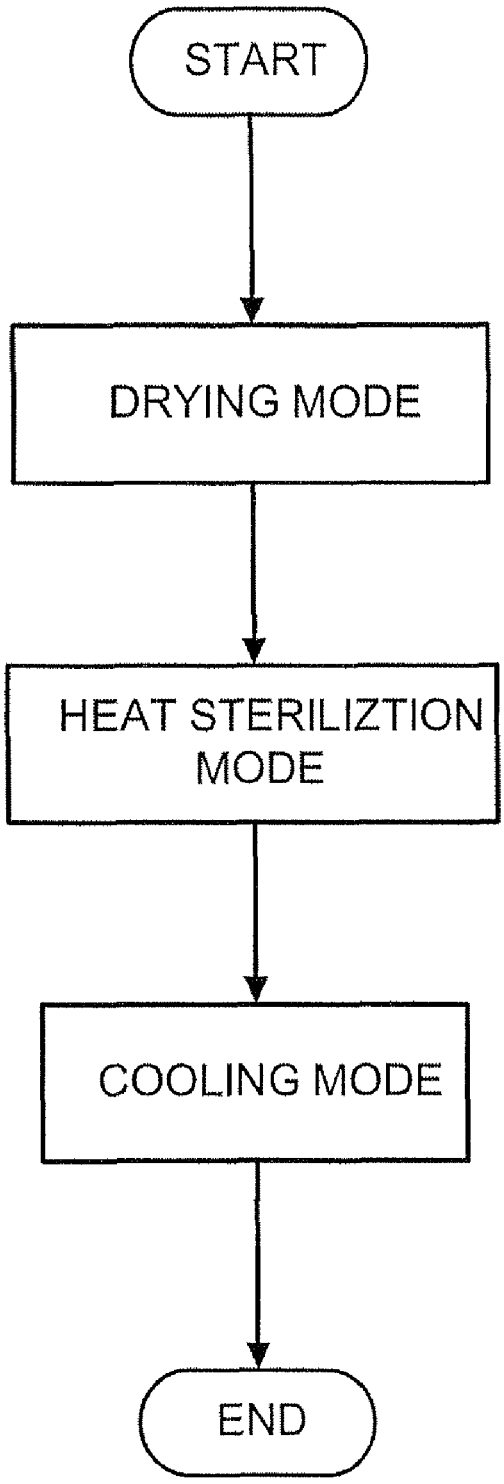
FIG. 12 is a flow chart illustrating a drying sequence executed by the above system.

Basically, the controller included in the casing is configured to provide a drying mode, a heat sterilization mode, and a cooling mode in this sequence, as shown in FIG. 12. In the drying mode, the heater 30 and the blower 40 are activated to direct the heated air flow to the cutter head 110 to remove the water off. The heat sterilization mode gives a mode in which the heater 40 is alone activated to heat the cutter head 110 to an elevated temperature for sterilization. In the subsequent cooling mode, the blower 40 is alone activate to direct the forced air flow for cooling the heated cutter head to make it ready for use.

The blower 40 is disposed to draw an outside air through an inlet 13 in the rear end of the casing 10 to direct the forced air flow into the dry chamber 20 through an air flow channel 42. Fitted into the bottom of the dry chamber 20 is a rectangular tray 50 which is shaped to receive a top end of the cutter head 110 and is formed in its bottom center with a draft port 52 through which the air flow proceed into the dry chamber 20. The heater 30 is mounted on the rear face of the tray 50 to heat the cutter head 110 as well as the air directed to the dry chamber 20.

Figure 5:
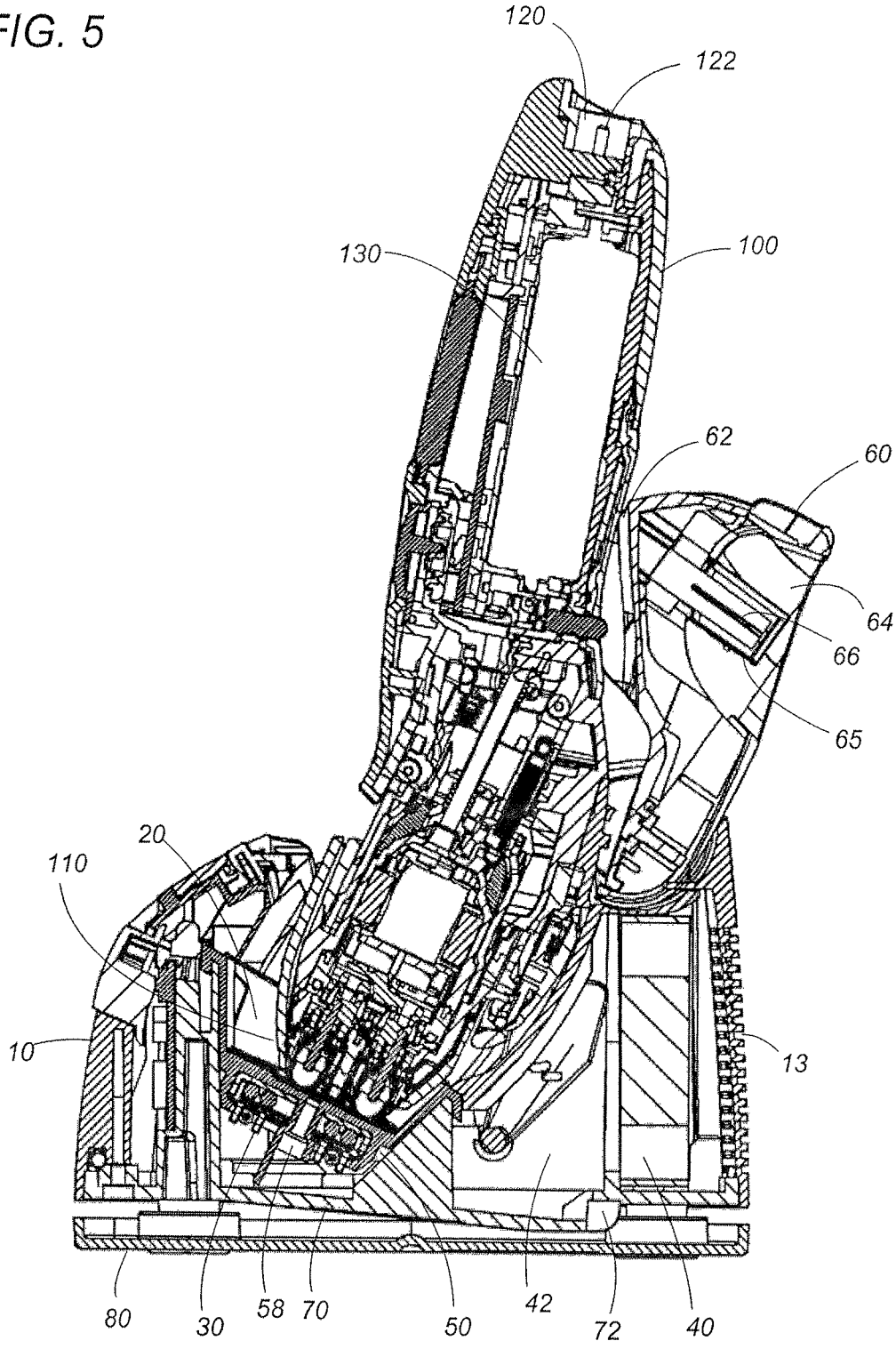
FIG. 5 is a sectional view of the above system shown with the cutter head received in the dry chamber.
Figure 6:
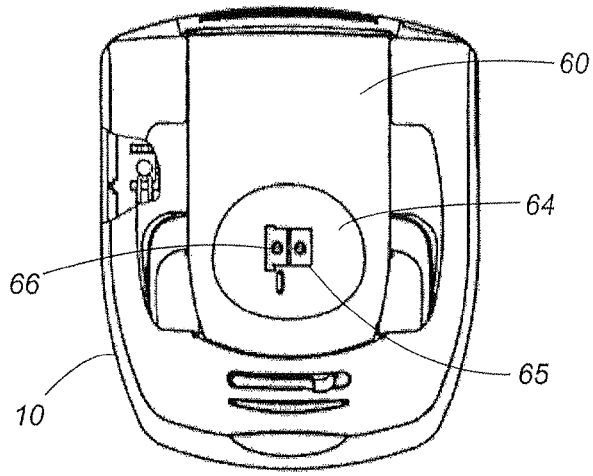
FIG. 6 is a top view of the above system with a shaver removed therefrom.
Figure 7:
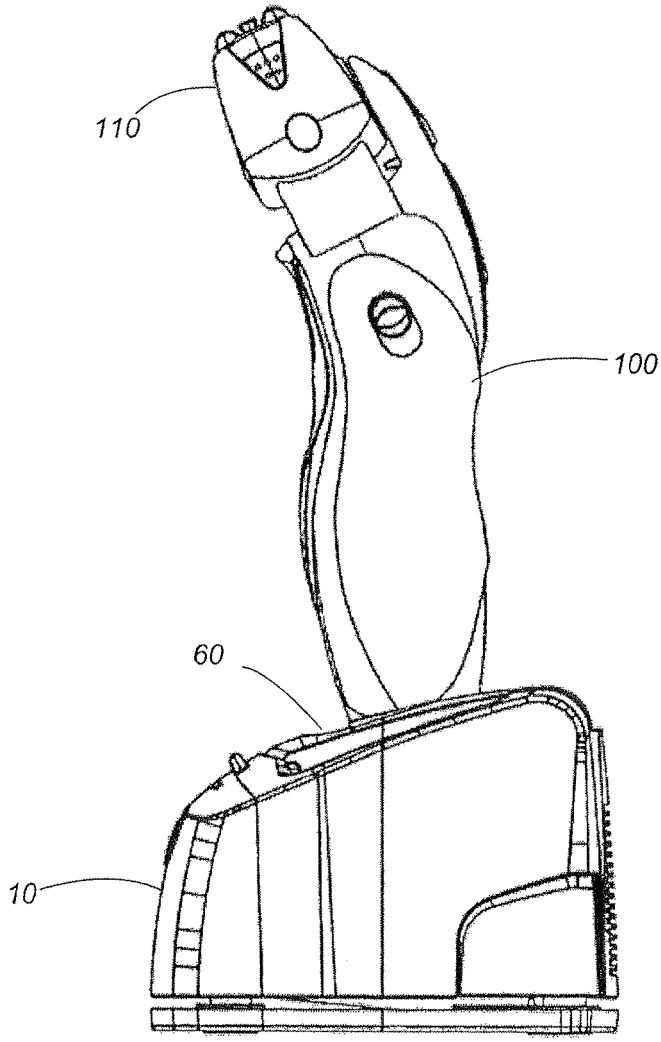
FIG. 7 is a side view of the above system with the shaver held upright on the lid.
Figure 8:
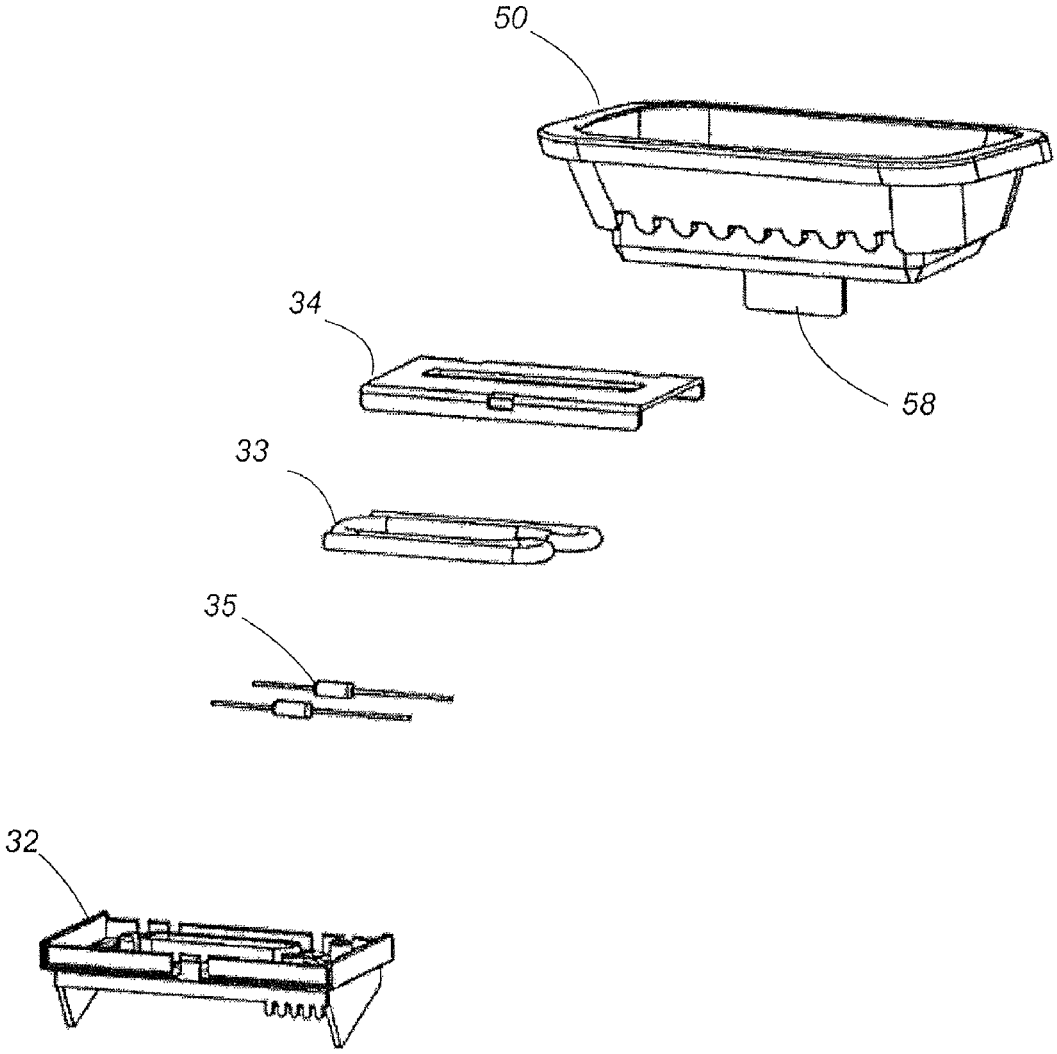
FIG. 8 is an exploded perspective view illustrating a tray and a heater assembly utilized in the above system.
Figure 9A:
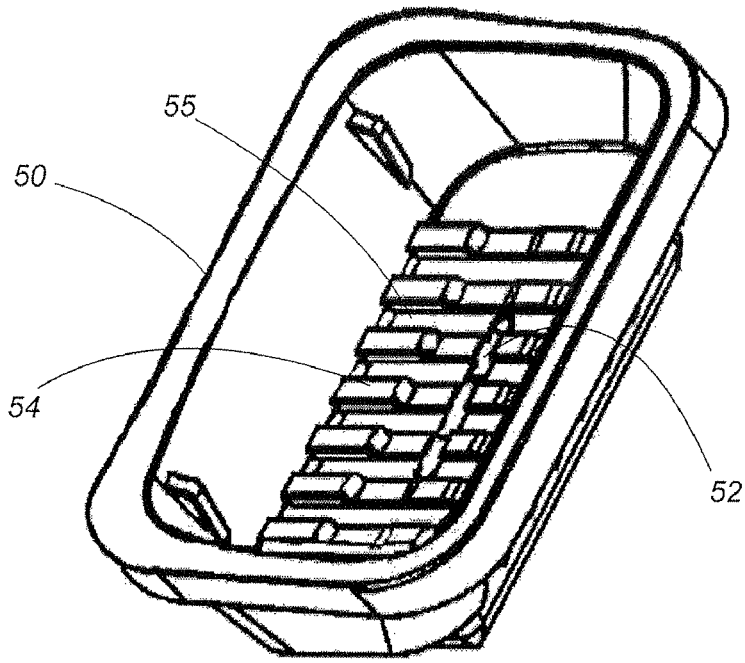
FIGS. 9A and 9B are respectively perspective views of the above tray.
Figure 9B:
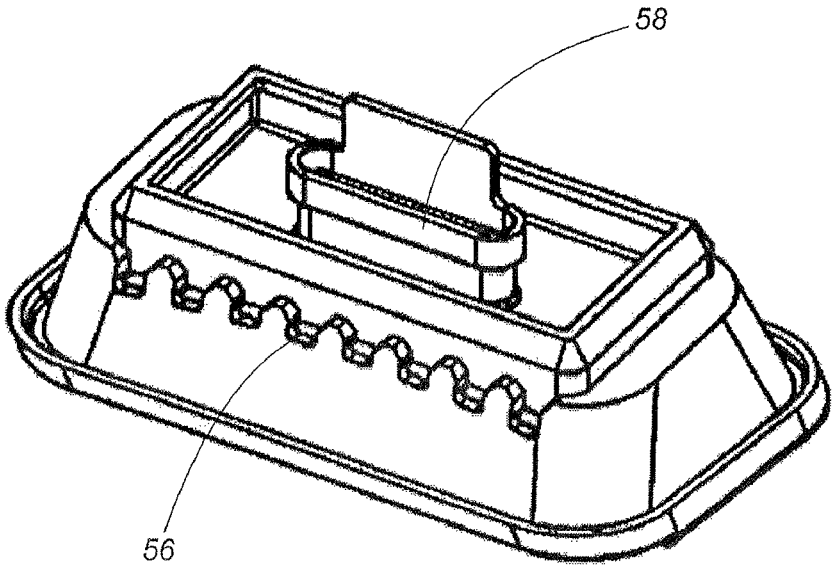

As shown in FIG. 2A, the lid 60 is formed at its rear face with a curved edge 62 shaped to engage with a middle portion of the shaver 100 for supporting the shaver 100 to the casing 10 with the cutter head 110 received in the dry shaver 100. Thus, the lid 60 has a support structure which functions to hold the shaver upside down when the lid 60 is in its open position, as shown in FIG. 5. Further, the lid 60 is formed in its top surface with a concave 64 shaped to receive the lower end of the shaver 100. Projecting from the center bottom of the concave 64 is a stud 65 which engages into a corresponding notch 120 in the lower end of the shaver 100 so as to hold the shaver upright on the lid 60 of the closed position as shown in FIG. 7. The stud 65 is formed with a charge terminal 66 which comes into contact with a corresponding contact 122 in the notch of the shaver for supplying a charge current from a charging circuit to a rechargeable battery in the shaver 100. Thus, the charging can be made when the shaver 100 is placed on the lid 60. The charging circuit is electrically connected to the charge terminal 65 by means of leads (not shown). The charging circuit and the controlling circuit 90 a realized by electronic parts mounted on a circuit board 76 disposed in the front end of the casing 10 and is energized by a power supply also provided in the casing 10. Further, another charge terminal 67 is provided on the rear face of the lid 60 for electrical connection to another contact on the back of the shaver 10 for charging the battery while the shaver is held upside down for drying the cutter head 110 in the dry chamber 20. Alternatively, the charge terminal may be provided on the side of the casing for charging the battery while the cutter head is received in the dry chamber.

Figure 10A:
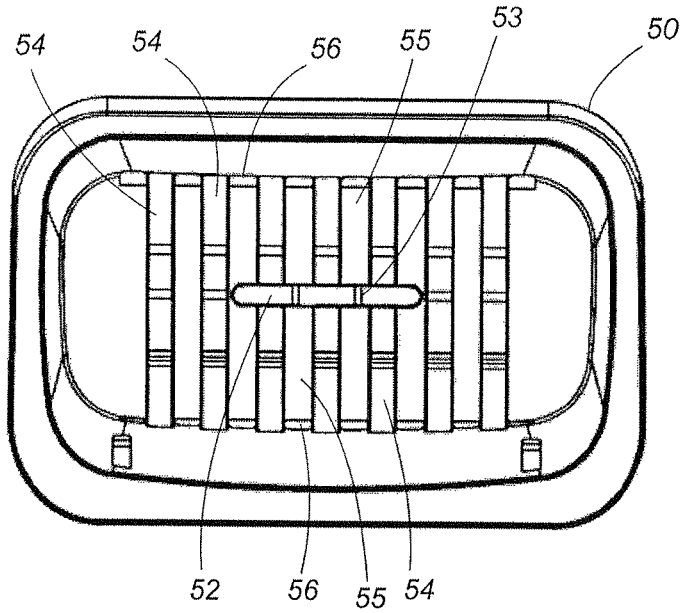
FIGS. 10A to 10C are respectively top, bottom, and sectional views of the above tray.
Figure 10B:
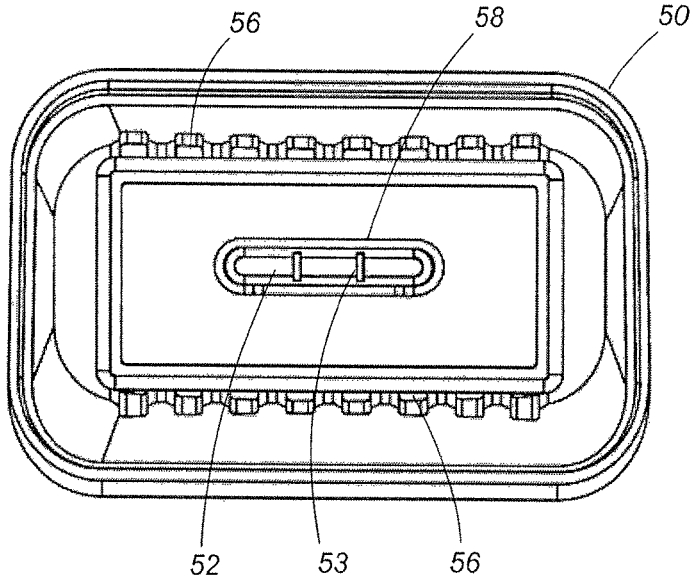
Figure 10C:
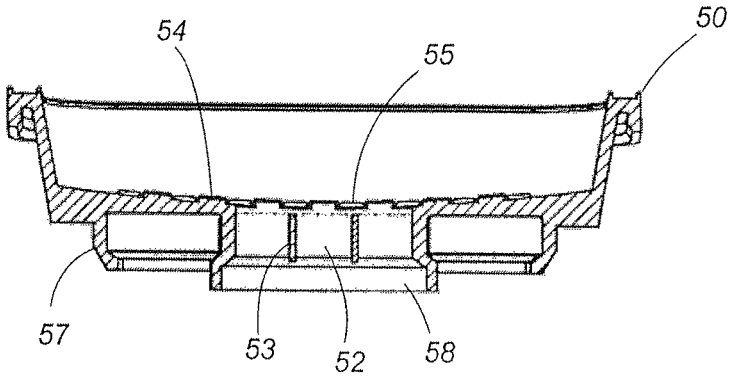
Figure 11A:
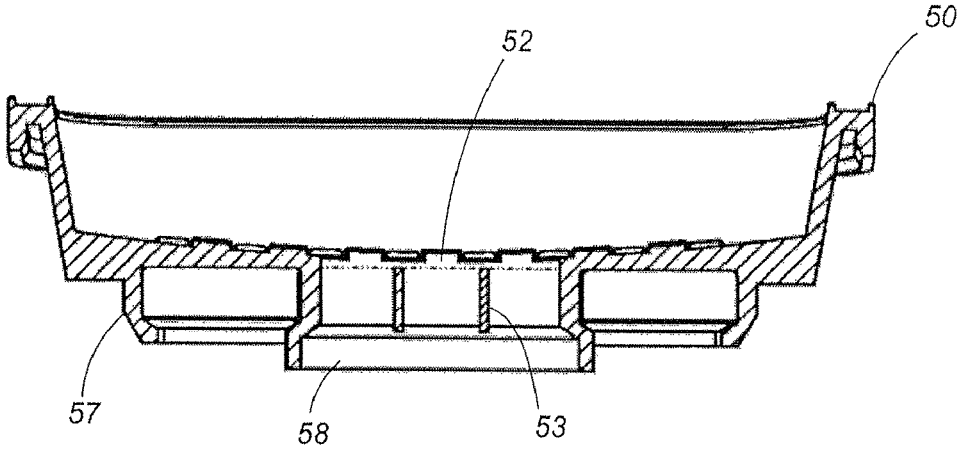
FIGS. 11A and 11B are respectively sectional views of the above tray.
Figure 11B:
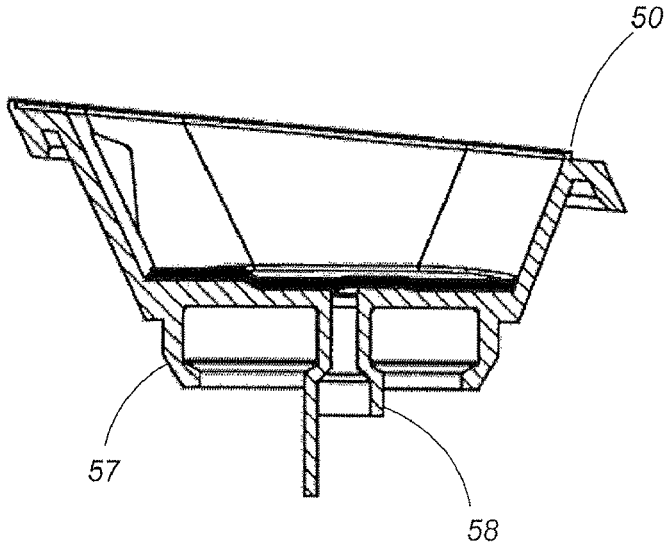

The tray 50 is made of an elastic material such as a silicone rubber having excellent thermal conductivity with sufficient elasticity to confer effective heat transfer to the cutter head as well as to provide a soft contact with a perforated shearing foil of the cutter head 110 for protecting the delicate foil from being damaged due to a load applied thereto as a consequence of the shaver being placed upside down. As shown in FIGS. 8 to 11, the tray 50 is provided with a duct 58 projecting downwardly into the air flow channel 42 to collect the forced air flow therefrom. The upper end of the duct 58 communicates with the draft port 52 which is elongated in the lengthwise direction of the tray 50 to cover a plurality of perforations at the top of the cutter head 110 in order to effectively introduce the air flow into the interior of the cutter head through the perforations. The draft port 52 is provided with cross-bars 53 for reinforcement of the tray around the draft port. The tray 50 is formed on its inner bottom with a plurality of ribs 54 spaced from each other to leave grooves 55 between the adjacent ones of the ribs 54. As best shown in FIG. 10A, each of the grooves 55 is formed at its opposite ends with drop holes 56 for drainage of water dipped from the cutter head.

The casing 10 has an inclined bottom wall 70 which is disposed below the dry chamber 20 or the tray 50 and extends downwardly to a drain port 72 at the rear end of the casing 10 in order to flow the water dropped out from the tray 50 towards the drain port for discharging the water out of the casing 10 into a recovery pan 80 detachable to the bottom of the casing 10.

Turning back to FIG. 8, the heater 30 is provided as an assembly composed of a frame 32 carrying an annular heating element 33, a conductor metal plate 34 fitted over the element 33, and fuses 34. The heater 30 is mounted on the outer bottom of the tray 50 within the confine of a skirt 57 depending from the periphery of the tray 50. The heater 30 thus mounted on the tray surrounds the duct 58 with the metal plate 34 in an intimate contact with the bottom of the tray 50 for heating the cutter head placed on the bottom of the dry chamber 20 as well as heating the air flowing through the duct 58. The casing 10 also includes a heater temperature sensor 38 for sensing the heater temperature as well as an ambient temperature sensor 39 for sensing the ambient temperature which are utilized to control the heater 30.

Figure 13:
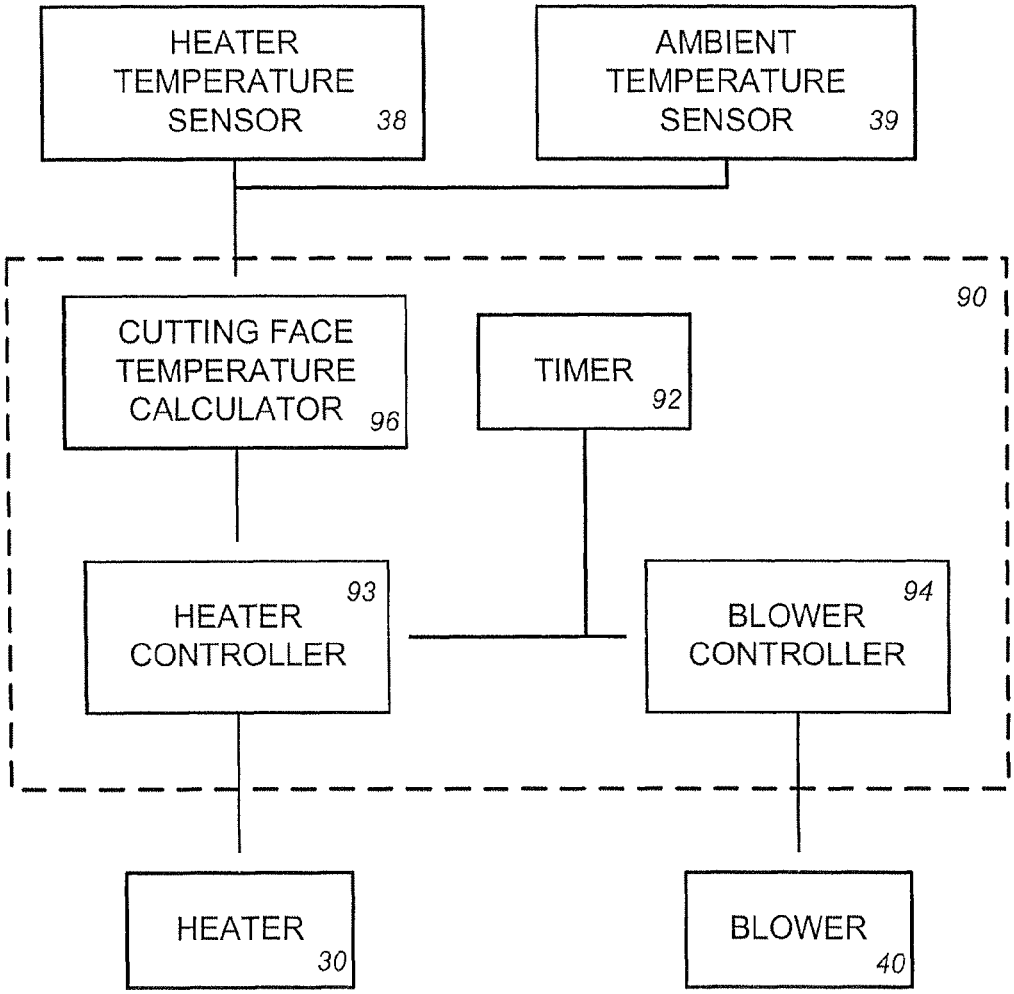
FIG. 13 is a block diagram illustrating a controller of the above system.
Figure 14:
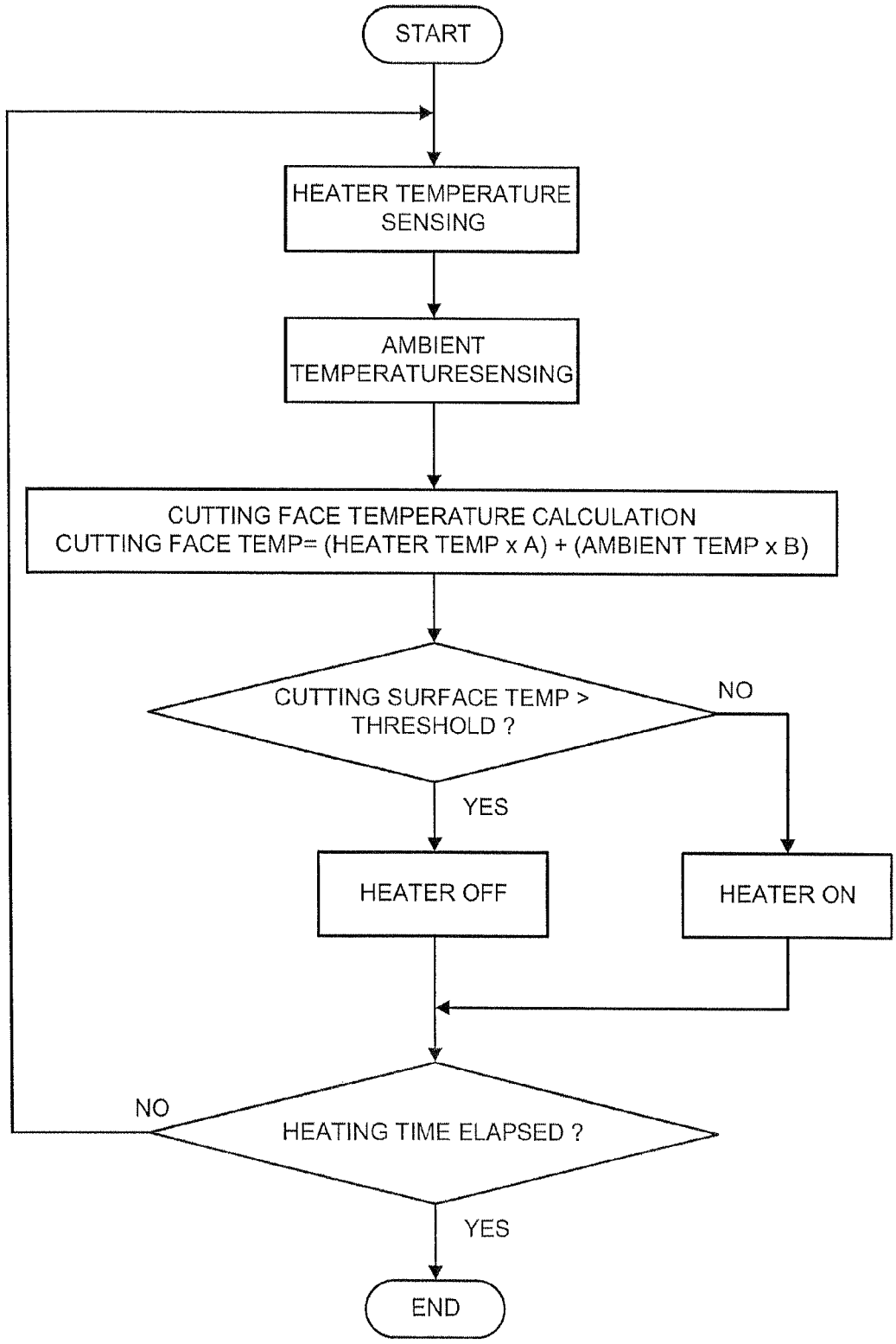
FIG. 14 is a flow chart illustrating a heating sequence realized by the above controller.
Figure 15:
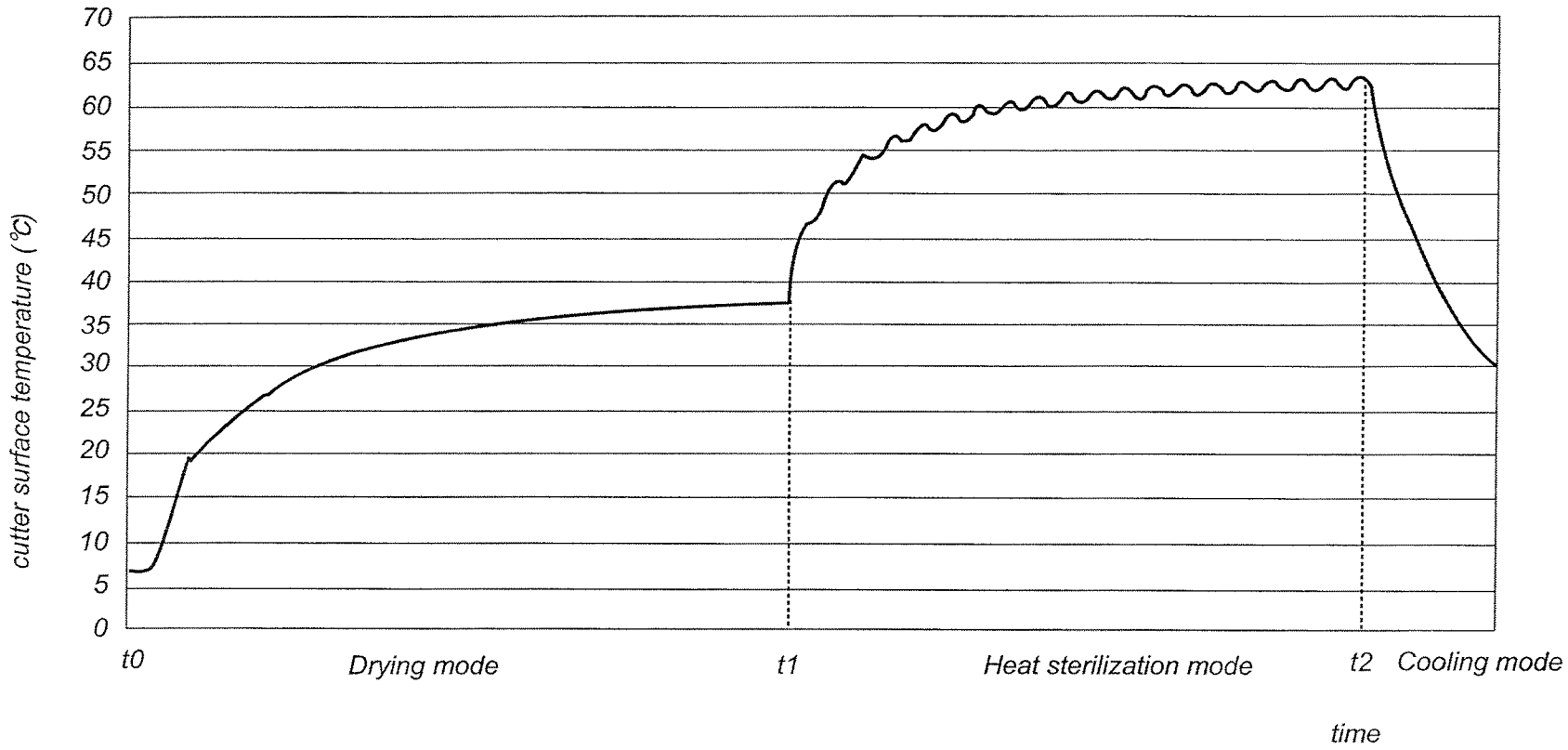
FIG. 15 is a graph illustrating a control of heating the cutter head realized by the above controller.

As schematically shown in FIG. 13, the controlling circuit 90 for control of the heater 30 and the blower 40 includes a timer 92, a heater controller 93, a blower controller 94, and a cutting face temperature calculator 96 which is configured to calculate a cutting face temperature based on the respective outputs from the heater temperature sensor 38 and the ambient temperature sensor 39. The timer 92 provides a time schedule defining the sequence of the drying mode, the heat sterilization mode, and the cooling mode. In the drying mode and the heat sterilization mode where the heater 30 is energized in combination with and without the blower 40, the heat controller 93 executes steps of FIG. 14, in which the heater temperature (H) and the ambient temperature (S) are constantly monitored to estimate the cutting face temperature (K) in accordance with an equation of $K=H\cdot A+S\cdot B$, where A and B are constants. Unless the estimated cutting face temperature (K) exceeds a threshold, the heater 30 is kept energized to raise the temperature (K) up to an intended temperature around at an intended temperature, for example, 38° C. in the drying mode, and 65° C. in the heat sterilization mode, as shown in FIG. 15. The above sequence is terminated at an elapse of a predetermined heating time, for example, 2 hours (t0 to t1) in the drying mode, and 20 minutes (t1 to t2) in the heat sterilization mode. The cooling mode starts after the heat sterilization mode to operate only blower 40 to direct the unheated air flow to the cutter head for rapidly cooling the same within a shortened time period, for example 10 minutes.

The invention claimed is:

1. A drying system for a hair removing device, said system comprising:

a casing having a dry chamber configured to detachably receive a cutter head (110) of said hair removing device;

a blower disposed in said casing to generate a forced air flow for drying said cutter head in said dry chamber; and a heater disposed in said casing to heat said cutter head in said dry chamber, wherein said casing is formed with an air flow channel for directing said forced air flow towards said cutter head, said dry chamber has its bottom defined by a tray which bears said cutter head, said tray being formed with a draft port through which said flow channel communicates into said dry chamber, wherein said tray is formed on its outer bottom with a duct which extends from said draft port and projects into said air flow channel, said heater is mounted on the outer bottom of said tray to surround said duct.

2. A drying system as set forth in claim 1, wherein said draft port is elongated to cover a plurality of hair entrapping perforations in said cutter head.

3. A drying system as set forth in claim 1, wherein said tray is made of an elastic material.

4. A drying system as set forth in claim 1, wherein said tray is formed in its top surface with at least one groove leading to a drop hole of said tray.

5. A drying system as set forth in claim 4, wherein said casing is formed with an inclined bottom wall disposed below said drop hole for receiving water out through said drop hole, said inclined bottom wall extending downwardly to a drain port for discharging the water out of said casing.

* * * * *